US007323342B2

(12) United States Patent
Varadaraj

(10) Patent No.: US 7,323,342 B2
(45) Date of Patent: Jan. 29, 2008

(54) METHOD FOR IMPROVING OIL DESALTING BY FORMING UNSTABLE WATER-IN-OIL EMULSIONS

(75) Inventor: Ramesh Varadaraj, Flemington, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 790 days.

(21) Appl. No.: 10/768,869

(22) Filed: Jan. 30, 2004

(65) Prior Publication Data

US 2004/0195179 A1 Oct. 7, 2004

Related U.S. Application Data

(60) Provisional application No. 60/460,339, filed on Apr. 4, 2003.

(51) Int. Cl.
*G01N 33/26* (2006.01)
*B01D 15/08* (2006.01)

(52) U.S. Cl. ..... 436/60; 436/161; 436/174; 436/175; 436/177; 422/69; 422/70; 210/656; 210/702; 208/251 R; 208/187; 208/188; 44/301

(58) Field of Classification Search ..... 436/60, 436/161, 174, 175, 177; 422/68.1, 69, 70, 422/101; 210/656, 748, 702, 749, 788; 208/251 R, 208/187, 188; 44/301
See application file for complete search history.

(56) References Cited

U.S. PATENT DOCUMENTS

| | | | | |
|---|---|---|---|---|
| 1,984,432 | A | 12/1934 | Robinson | 196/41 |
| 2,904,485 | A | 9/1959 | Tarmy et al. | 204/154 |
| 3,950,245 | A | 4/1976 | Aliev | 208/187 |
| 4,738,795 | A | 4/1988 | Farnand | 252/340 |
| 6,228,239 | B1 | 5/2001 | Manalastas et al. | 204/567 |
| 6,555,009 | B2 * | 4/2003 | Varadaraj | 210/708 |
| 7,008,536 | B2 * | 3/2006 | Varadaraj et al. | 210/243 |
| 7,108,780 | B2 * | 9/2006 | Varadaraj | 208/251 R |

FOREIGN PATENT DOCUMENTS

| | | |
|---|---|---|
| WO | WO 00/50541 | 8/2000 |
| WO | WO 03/087263 | 10/2003 |

OTHER PUBLICATIONS

Stark, J. L., et al.: "New Method Prevents Desalter Upsets From Blending Incompatible Crudes" Oil & Gas Journal, Pennwell Publishing Co. Tulsa, US, vol. 100, No. 11, Mar. 18, 2002, pp. 89-91, XP001101619.

* cited by examiner

*Primary Examiner*—Maureen M. Wallenhorst
(74) *Attorney, Agent, or Firm*—Ramesh Varadaraj

(57) ABSTRACT

A method for determination for a given oil the relative stability of a water-in-oil emulsion that will be formed by that oil with water comprises measuring for the given oil the weight fraction of the oil that is most strongly adsorbed on a silica gel column successively eluted with n-hexane, toluene and methylene chloride-methanol mixture solvents and determining whether said weight fraction is greater than about 0.05; with a value above 0.05 being determinative of an emulsion more stable than one with a value less than 0.05.

11 Claims, 3 Drawing Sheets

METHOD FOR IMPROVING OIL DESALTING BY FORMING UNSTABLE WATER-IN-OIL EMULSIONS

This application claims the benefit of U.S. Provisional application 60/460,339 filed Apr. 4, 2003.

FIELD OF THE INVENTION

The invention relates generally to oil desalting and more particularly to improvements in the aqueous treatment of crude oils for desalting where water-in-oil emulsions are formed.

BACKGROUND OF THE INVENTION

Removal of corrosive water-soluble salts, particularly chlorides of sodium and potassium from crude oil is an important processing operation in refining of crude oils. The process of desalting usually involves addition of 1 to 20 weight percent wash water to the crude oil, mixing to form a water-in-crude oil emulsion and then subjecting the water-in-crude oil emulsion to electrostatic demulsification or hydrocyclone treatment. Under the influence of electrostatic or centrifugal fields the dispersed water droplets coalesce and the water-in-oil emulsion is demulsified. Water and the water-soluble salts are separated from the crude oil and removed. Key to the efficiency of the desalting process is the formation of unstable water-in-oil emulsions. Most heavy crude oils that contain asphaltenes and naphthenic acids tend to form stable water-in-oil emulsions. These stable water-in-oil emulsions are difficult to demulsify and tend to form large volumes of a rag layer in the separator vessels. Formation of rag layers result in substantial oil loss and reduce the efficiency of dewatering and desalting processes. Current methods using centrifuges, hydrocyclones and electrostatic demulsifiers require large doses of demulsifier chemicals, high operation temperature and long residence times to desalt and/or dewater these water-in-oil emulsions. Thus, there is a continuing need for improved cost effective methods to demulsify and desalt water-in-oil emulsions especially those formed from heavy crude oils. Further, there is a need to predict the ability of a heavy crude oil to form stable emulsions so that preventive measures can be undertaken prior to wash water addition and formation of water-in oil emulsions. The present invention addresses these needs.

SUMMARY OF THE INVENTION

Broadly stated, the present invention provides a method to determine for a given oil the relative stability of an emulsion that will be formed by that oil with water and using that determination in desalting crude oils.

The invention includes a method for determination for a given oil, especially crude oils, crude oil distillates, residua of crude oil distillation and mixtures thereof, the relative stability of a water-in-oil emulsion that will be formed by that oil with water comprising:

a) measuring for the oil the weight fraction of the oil that is most strongly adsorbed on a silica gel column successively eluted with n-hexane, toluene and methylene chloride—methanol mixture solvents;

b) determining whether said weight fraction is greater than about 0.05; with a value above 0.05 being determinative of an emulsion more stable than one with a value less than 0.05.

The invention also includes an improved method to desalt a crude oil comprising:

a) measuring for the oil the weight fraction, C of the oil that is most strongly adsorbed on a silica gel column successively eluted with -hexane, toluene and methylene chloride—methanol mixture solvents;

b) determining whether said weight fraction, C is greater than about 0.05, and, if above 0.05;

c) treating the oil to obtain a treated oil wherein the weight fraction, C of the treated oil that is most strongly adsorbed on a silica gel column successively eluted with -hexane, toluene and methylene chloride—methanol mixture solvents is less than about 0.05;

d) adding water to the treated oil, in the range of 1 to 20 wt % based on the weight of the treated oil;

e) mixing the treated oil and water to form a water-in-treated oil emulsion;

f) coalescing the water of the water-in-treated oil emulsion;

g) separating the coalesced water to obtain a desalted crude oil.

DETAILED DESCRIPTION OF THE INVENTION

Figure 1:
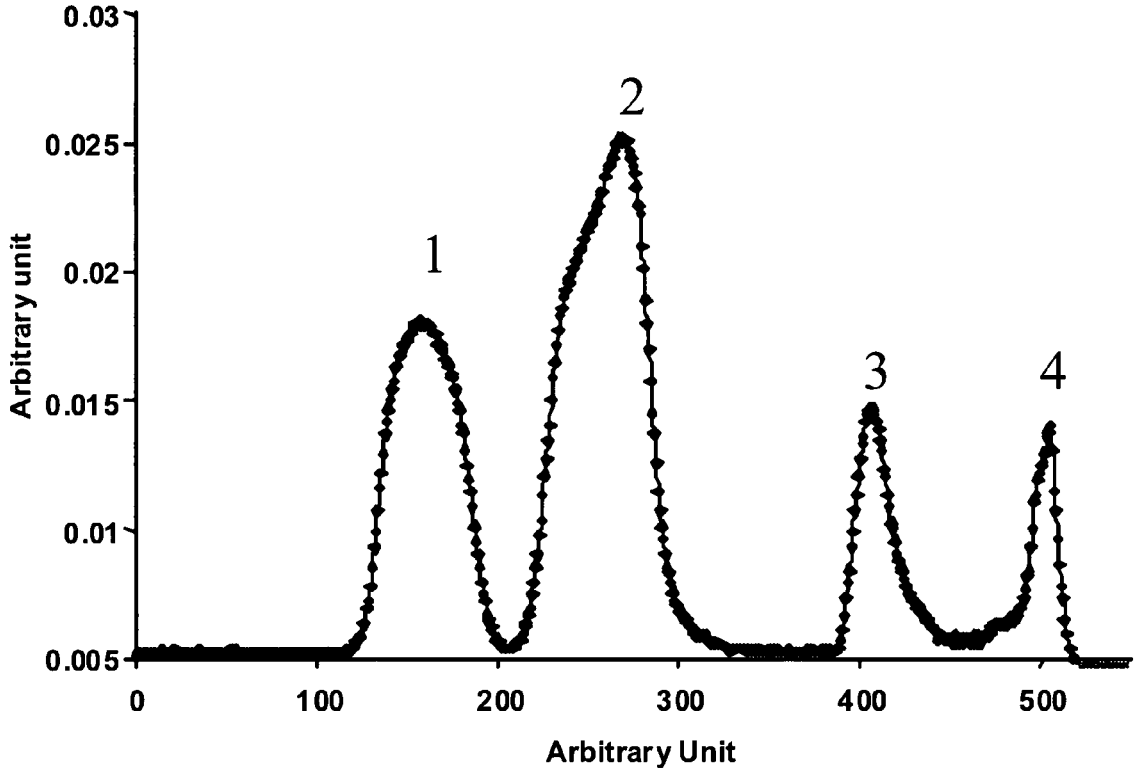
FIG. 1 is typical plot obtained from a silica gel column adsorption experiment using a crude oil and successively eluted with n-hexane, toluene and methylene chloride-methanol mixture solvents. Typically, the oil is separated into four fractions denoted by peaks labeled 1, 2,3 and 4. Peak #4 corresponds to the most strongly adsorbed fraction.

Hydrocarbon oils that contain asphaltenes and naphthenic acids such as crude oils tend to form water-in-oil emulsions with varying degrees of stability. The present invention is based on the discovery that the relative stability of a water-in-oil emulsion is related to weight fraction of the oil that is most strongly adsorbed on a silica gel column with successive elutions with n-hexane, toluene and methylene chloride—methanol mixture solvents. The weight fraction of the oil that is most strongly adsorbed on a silica gel column with successive elutions with said solvents is herein after defined as the composition parameter, C.

One significance of the composition parameter, C, is that it is an indicator of the ability of an oil to form stable water-in-oil emulsions. The composition parameter, C can have values in the range of 0 to 1. For a given oil, a value for C between 0 to 0.05 corresponds to a low ability for that oil to form water-in-oil emulsions. Even if such oils form water-in-oil emulsions, the emulsions will be unstable and will easily demulsify upon coalescence and phase separation. Examples of such coalescence and phase separation means are centrifugal or electrostatic fields and percolation or passage through a porous sand bed. Values for C above about 0.05, indicate increasing ability for the oil to form stable water-in-oil emulsions.

Any method that lowers the composition parameter, C, of a given oil will reduce its ability to form stable emulsions while increasing it will increase its ability to form stable water-in-oil emulsions.

Some non-limiting examples of treatments of hydrocarbon oils that can result in a reduction in the value of C of the oil are:

a) blending low asphaltene and low naphthenic acid containing oils with the oil;

b) thermal or electrochemical treatments of the oil under conditions where the total acid content is reduced, for example, thermal or catalytic decarboxylation;

c) chemical treatment of the oil where the naphthenic acid is chemically altered to a non-acidic form, for example conversion of the acids to an esters or ketones;

d) any treatment of the oil that extracts asphaltenes from the oil for example solvent deasphalting;

e) any treatment that extracts naphthenic acid from the oil.

Some non-limiting examples of treatments of hydrocarbon oils that can result in an increase in the C value of the oil are:

a) thermal, biological or photochemical oxidation of the oil;

b) thermal or catalytic treatments that increase the amount of asphaltenes;

c) blending with high asphaltenes and naphthenic acid containing oils;

d) addition of high molecular weight naphthenic acids or asphaltenes.

The oil comprising the water-in-oil emulsion can be any oil including crude oils, crude oil distillates, and hydrocarbon oil residua obtained from crude oil distillation or mixtures thereof. Through a determination of the composition parameter, C a method to prepare an unstable water-in-oil emulsion for a given oil is possible. The method comprises:

a) measuring for the oil the weight fraction, C of the oil that is most strongly adsorbed on a silica gel column successively eluted with -hexane, toluene and methylene chloride—methanol mixture solvents;

b) determining whether said weight fraction, C is greater than about 0.05, and, if above 0.05;

c) treating the oil to obtain a treated oil whose C value is less than about 0.05;

e) adding water in the range of 1 to 70 weight percent based on the weight of the treated oil to the said treated oil; and f) mixing to form an unstable water-in-oil emulsion.

The water content of the water-in-oil emulsions can vary in the range of 1 to 70 wt % based on the weight of the oil. The water comprising the water-in-oil emulsion can include halides, sulfate and carbonate salts of Group I and Group II elements of the long form of The Periodic Table of Elements, and mixtures thereof in a range of 0.01 wt % to 20 wt % based on the weight of water. The water-in-oil emulsion can have dispersed water droplets in the size range of 0.05 to 200-micron diameter. The invention is particularly useful in situations wherein the dispersed water droplets are in the range of 0.05 to 50 microns.

One process where preparing an unstable water-in-oil emulsion is important is in the process of desalting oils, particularly crude oils. An improved oil desalting method comprises:

a) measuring for the oil the weight fraction, C of the oil that is most strongly adsorbed on a silica gel column successively eluted with -hexane, toluene and methylene chloride—methanol mixture solvents;

b) determining whether said weight fraction, C is greater than about 0.05, and, if above 0.05;

c) treating the oil to obtain a treated oil wherein the weight fraction, C of the treated oil that is most strongly adsorbed on a silica gel column successively eluted with -hexane, toluene and methylene chloride—methanol mixture solvents is less than about 0.05;

d) adding water to the treated oil, in the range of 1 to 20 wt % based on the weight of the treated oil;

e) mixing the treated oil and water to form a water-in-treated oil emulsion;

f) coalescing the water of the water-in-treated oil emulsion;

g) separating the coalesced water to obtain a desalted crude oil.

The water droplets of the water-in-oil emulsion can be coalesced by methods such as but not limited to centrifugation, electrostatic treatment, hydrocyclone treatment, gravity settling and porous sand bed percolation.

The following examples are non-limiting illustrations of the invention.

Measurement of Composition Parameter, C

Eight crude oils, Talco, Tulare, Miandoum, Kome, Hamaca, Cold Lake, Hoosier and Celtic were chosen. For each oil the weight fraction, C of the oil that is most strongly adsorbed on a silica gel column was measured by a thin layer chromatography technique wherein the silica gel column was successively eluted with n-hexane, toluene and methylene chloride/methanol mixture in a weight ratio of 95/5. A commercially available IATROSCAN TLC/FID instrument (IATRON Laboratories, Inc. Tokyo, 101 Japan) was used. In a typical measurement 10 mg a given crude oil was diluted with 1 ml of methylene chloride to provide a solution of crude oil in methylene chloride. This solution was used to spot the column by the spotting method known to one of ordinary skill in the art of column chromatography. The crude oil spotted silica gel column was then successively eluted with n-hexane for 10 cms movement of the mobile phase, toluene for additional 5 cms movement of the mobile phase and methylene chloride/methanol mixture at a 95/5 ratio for additional 2 cms movement of the mobile phase. The methylene chloride/methanol mixture can comprise methylene chloride and methanol in a ratio range of 99 parts of methylene chloride to 1 part of methanol by weight to 80 parts of methylene chloride to 20 parts of methanol by weight. A mixture of methylene chloride and methanol at a ratio of 95 parts of methylene chloride to 5 parts of methanol is preferred. While methanol is the preferred solvent ethanol or n-propanol or iso-propanol can also be used in place of methanol.

After the last solvent elution the column was air dried and subject to flame ionization detection known to one of ordinary skill in the art. A typical chromatogram is shown in FIG. 1. The area under each of the 4 peaks was determined. The weight fraction of the oil that is most strongly adsorbed on a silica gel column successively eluted with n-hexane, toluene and methylene chloride/methanol mixture was calculated as the area under peak #4/total area under all the four peaks. This value is the composition parameter C.

Experimental Determination of Emulsion Stability: Procedure-1 (Berea Filtration or Porous Sand Bed Percolation)

With each crude oil, the corresponding water-in-crude oil emulsion #1 was made at a ratio of 60% water: 40% crude oil. To 40 g of the crude oil were added 60 g of the corresponding synthetic brine and mixed. A Silverson mixer supplied by Silverson Machines, Inc. East Longmeadow, Mass. was used for mixing. Mixing was conducted at 25° C. and at 400 to 600 rpm for a time required to disperse all the water into the oil. Water was added to the crude oil in aliquots spread over 5 additions.

The stability of the emulsions was determined by passing the emulsions through a Berea sandstone column using procedure is described herein. A commercially available special fritted micro-centrifuge tube that is comprised of two parts is used as the container for the experiment. The bottom part is a tube that retains any fluid flowing from the top tube. The top part is similar to the usual polypropylene micro-centrifuge tube, except that the bottom is a frit that is small enough to hold sand grains back, but allows the easy flow of fluid. In addition, the tubes come supplied with lids to each part, one of which serves also as a support that allows the top to be easily weighed and manipulated while upright. These micro-centrifuge tubes are available from Princeton Separations, Inc., Adelphia N.J. and are sold under the name "CENTRI-SEP COLUMNS."

A heated centrifuge is used to supply the pressure to flow the pusher fluid through a sand pack placed in the upper tube. The centrifuge supplied by Robinson, Inc., (Tulsa, Okla.) Model 620 was used. The temperature is set at 72° C. The top speed is about 2400 revolutions per minute (RPM) and the radius to the sandpack is 8 centimeters (cm), which gives a centrifugal force of 520 g. All weights are measured to the nearest milligram.

The columns come supplied with a small supply of silica gel already weighed into the tube. This is discarded, and the weights of both sections noted. About 0.2 grams (g) of sand is weighed into the top and 0.2±0.01 g of emulsion added to the sandpack. Typical sands used for this experiment are Berea or Ottowa sands. For simplicity, one may use unsieved, untreated Ottawa sand. Alternatively, one may use one fraction that passes through 100 Tyler mesh, but is retained by a 150 mesh, and another fraction that passes through the 150 Tyler mesh, blended in a ten to one ratio respectively. The tube is weighed again, then centrifuged for one minute at full speed on the heated centrifuge. The bottom tube is discarded and the top is weighed again, which gives the amount of sand and emulsion remaining in the top. The sand is now in an emulsion wetted state, with air and emulsion in the pore spaces.

A bottom tube is weighed and placed below the top tube to capture the effluent during centrifugation. Both tubes are then centrifuged for a noted time (5 to 15 minutes). After centrifugation, the bottom tube was weighed again. The difference in weights is the weight of emulsion that passed through the sand-pack. The fluid in the bottom receptacle was drawn through a graduated micropipette. The amount of free water that had separated, if any, was noted. From knowledge of the amount of emulsion used in the experiment and the % water separated, emulsion stability was calculated as the wt % water retained by the emulsion.

Experimental Determination of Emulsion Stability: Procedure-2 (Electrostatic Field)

With each crude oil, the corresponding water-in-crude oil emulsion #2 was made at a ratio of 20% water: 80% crude oil. To 80 g of the crude oil were added 20 g of the corresponding synthetic brine and mixed. A Silverson mixer supplied by Silverson Machines, Inc. East Longmeadow, Mass. was used for mixing. Mixing was conducted at 25° C. and at 400 to 600 rpm for a time required to disperse all the water into the oil. Water was added to the crude oil in aliquots spread over 5 additions.

The stability of prepared emulsions were determined by the electrostatic demulsification technique. Electrostatic demulsification was conducted using a model EDPT-128™ electrostatic dehydrator and precipitation tester available from INTER-AV, Inc., San Antonio, Tex. Demulsification was conducted at an 830 volt/inch potential for 30 to 180 minutes at temperatures of 60 and 85° C. The amount of water separating from the electrostatic demulsifier tube was measured. From knowledge of the amount of emulsion used in the experiment and the % water separated, emulsion stability was calculated as the wt % water retained by the emulsion.

Figure 2:
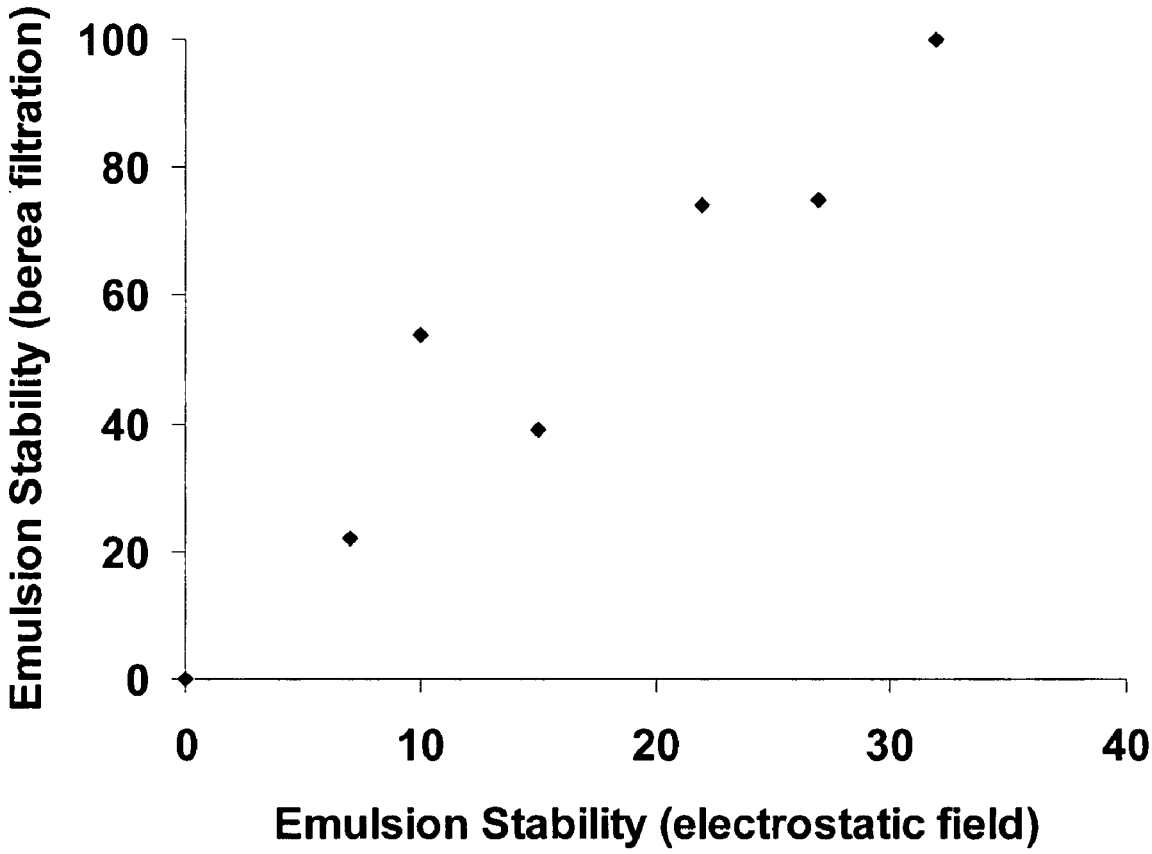
FIG. 2 is a plot of emulsion stability determined by berea filtration method versus electrostatic field method.

FIG. 2 is a plot of emulsion stability determined by berea filtration method versus electrostatic field method. The disclosed correlation enables determination of the stability of an emulsion determined by the berea filtration method from a knowledge of the stability determined by the electrostatic field method and vice versa.

Figure 3:
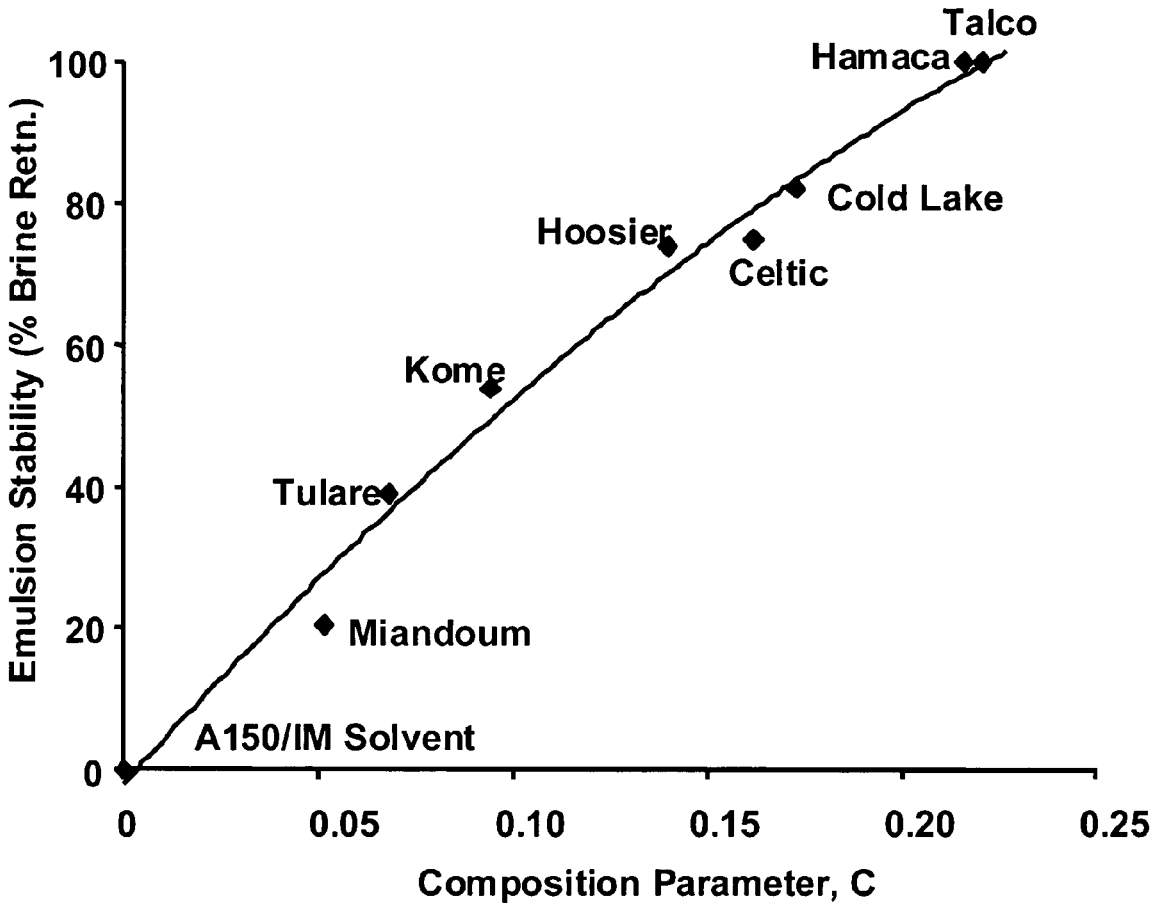
FIG. 3 is a plot of emulsion stability versus the composition parameter, C.

Correlation Between Experimentally Determined Emulsion Stability and the Composition Parameter, C A plot of experimentally determined emulsion stability (procedure-1) versus C is shown in FIG. 3. The observed trend is emulsion stability increases with increasing value of the composition parameter, C. Further such a smooth correlation for a set of crude oils (which are complex oils from a composition point of view) is unexpected. This unexpected result as claimed in the instant invention fulfills a long standing need of a method for determination for a given oil, especially crude oils, crude oil distillates, residua of crude oil distillation and mixtures thereof, the relative stability of a water-in-oil emulsion that will be formed by that oil with water. Further, the correlation holds only for the strongest fraction that is adsorbed, that is fraction of oil corresponding to peak #4. This is an unexpected result since it is commonly believed that the resin fraction of the oil represented by peak #3 determines the stability of water-in-oil emulsions. Neither the fraction corresponding to peak #3 or the combined fraction of peaks #3 and #4 can be correlated to the stability of the corresponding water-in-oil emulsion formed from that oil.

Method to Prepare Low Stability Water-in-oil Emulsions Aided by the Emulsion Stability Expression Mixing 50 wt % Talco crude oil with 50 wt % isopar-M solvent, an oil mixture was made whose C had a value of 0.052. Using the correlation in FIG. 1, the emulsion stability of the mixture is predicted to be about 58%. The experimentally determined value for the mixture based on procedure-1 described above was 51%.

Thus the method of blending two oils to lower the value of the composition parameter, C results in lowering the emulsion stability. The method of blending two oils to lower the composition parameter, C is only an illustrative example and is not limiting. Any method that reduces the composition parameter, C can be employed.

What is claimed is:

1. A method for determination for a given oil, the relative stability of a water-in-oil emulsion that will be formed by that oil with water comprising:

a) measuring for the oil the weight fraction of the oil that is most strongly adsorbed on a silica gel column successively eluted with n-hexane, toluene and methylene chloride-methanol mixture solvents;

b) determining whether said weight fraction is greater than about 0.05; with a value above 0.05 being determinative of an emulsion more stable than one with a value less than 0.05.

2. The method of claim 1 wherein said oil is a crude oil, crude oil distillate, residua from crude oil distillation and mixtures thereof.

3. The method of claim 1 wherein said water comprises halides, sulfate and carbonate salts of Group I and Group II elements of the long form of The Periodic Table of Elements and mixtures thereof.

4. The method of claim 1 wherein said water-in-oil emulsion has dispersed water droplets in the size range of 0.05 to 200 micron diameter.

5. The method of claim 1 wherein said methylene chloride—methanol mixture comprises methylene chloride and methanol in a ratio range of 99 parts of methylene chloride to 1 part methanol by weight to 80 parts of methylene chloride to 20 parts methanol by weight.

6. A method to desalt an oil comprising:

a) measuring for the oil the weight fraction, C of the oil that is most strongly adsorbed on a silica gel column successively eluted with n-hexane, toluene and methylene chloride—methanol mixture solvents;

b) determining whether said weight fraction, C is greater than about 0.05, and, if above 0.05;

c) treating the oil to obtain a treated oil wherein the weight fraction, C of the treated oil that is most strongly adsorbed on a silica gel column successively eluted with -hexane, toluene and methylene chloride—methanol mixture solvents is less than about 0.05;

d) adding water to the treated oil, in the range of 1 to 20 wt % based on the weight of the treated oil;

e) mixing the treated oil and water to form a water-in-treated oil emulsion;

f) coalescing the water of the water-in-treated oil emulsion;

g) separating the coalesced water to obtain a desalted crude oil.

7. The method of claim 6 wherein said oil is a crude oil, crude oil distillate, residua from crude oil distillation and mixtures thereof.

8. The method of claim 6 wherein said treatment of the oil is selected form the group consisting of solvent deasphalting, thermal treatment for naphthenic acid reduction, electrochemical treatment for naphthenic acid reduction, blending with a second oil, chemical treatment for naphthenic acid conversion to naphthenate ester, naphthenic acid extraction treatment and combinations thereof.

9. The method of claim 6 wherein said coalescence is achieved by centrifugation, hydrocyclone treatment, electrostatic treatment, porous bed percolation and combinations thereof.

10. The method of claim 6 wherein said methylene chloride—methanol mixture comprises methylene chloride and methanol in a ratio range of 99 parts of methylene chloride to 1 part methanol by weight to 80 parts of methylene chloride to 20 parts methanol by weight.

11. A method to form an unstable water-in-oil emulsion from an oil and water comprising:

a) measuring for the oil the weight fraction, C of the oil that is most strongly adsorbed on a silica gel column successively eluted with n-hexane, toluene and methylene chloride—methanol mixture solvents;

b) determining whether said weight fraction, C is greater than about 0.05, and, if above 0.05;

c) treating the oil to obtain a treated oil wherein the weight fraction, C of the treated oil that is most strongly adsorbed on a silica gel column successively eluted with n-hexane, toluene and methylene chloride—methanol mixture solvents is less than about 0.05;

d) adding water to the treated oil, in the range of 1 to 20 wt % based on the weight of the treated oil;

e) mixing the treated oil and water to form an unstable water-in-oil emulsion.

* * * * *